United States Patent [19]

Whiting

[11] Patent Number: 4,602,433

[45] Date of Patent: Jul. 29, 1986

[54] WALLPAPER KNIFE

[76] Inventor: Dennis T. Whiting, Tamar, Copse La., Church Crookham, Aldershot, Hampshire, GU13 0RY, United Kingdom

[21] Appl. No.: 666,876

[22] Filed: Oct. 31, 1984

[51] Int. Cl.[4] ..... B26B 3/08

[52] U.S. Cl. ..... 30/294; 30/162; 30/289; 30/293

[58] Field of Search ..... 30/162, 293, 294, 291, 30/290, 289

[56] References Cited

U.S. PATENT DOCUMENTS

| | | | |
|---|---|---|---|
| 2,549,542 | 4/1951 | Stair | 30/162 |
| 2,690,805 | 10/1954 | Gransten | 30/294 |
| 2,770,879 | 11/1956 | Seymour | 30/293 |
| 2,853,778 | 9/1958 | Pratt et al. | 30/294 |
| 3,726,010 | 4/1973 | Yokoyama | 30/293 |
| 4,043,038 | 8/1977 | Selfridge | 30/293 |
| 4,106,196 | 8/1978 | Smithline | 30/294 |

FOREIGN PATENT DOCUMENTS

| | | |
|---|---|---|
| 2946914 | 6/1981 | Fed. Rep. of Germany . |
| 477057 | 12/1937 | United Kingdom . |
| 508438 | 6/1939 | United Kingdom . |
| 650647 | 2/1951 | United Kingdom . |
| 707186 | 4/1954 | United Kingdom . |
| 1523168 | 8/1978 | United Kingdom . |
| 1521439 | 8/1978 | United Kingdom . |
| 2040207B | 9/1982 | United Kingdom . |
| 2126939 | 4/1984 | United Kingdom . |

*Primary Examiner*—Donald R. Schran
*Attorney, Agent, or Firm*—Lee A. Strimbeck

[57] ABSTRACT

A knife for trimming wallpaper has two tapered body parts 8 and 9 between which is held a tipped cutting blade 5. The body parts have external side faces which are flat around central recesses. When the side face of a body part is in engagement with a flat surface 4, such as a wall, the tip of the blade is a predetermined distance from the plane of the flat surface. When the end face of the body is brought into engagement with a surface transverse to the flat surface, such as an architrave 3, the knife can be drawn down in a stable manner to cut the wallpaper at the predetermined distance in a neat fashion.

The two parts of the body are identical and contain crossing inclined grooves to contain the blade so that it projects from a corner of the body.

22 Claims, 8 Drawing Figures

FIG.1.
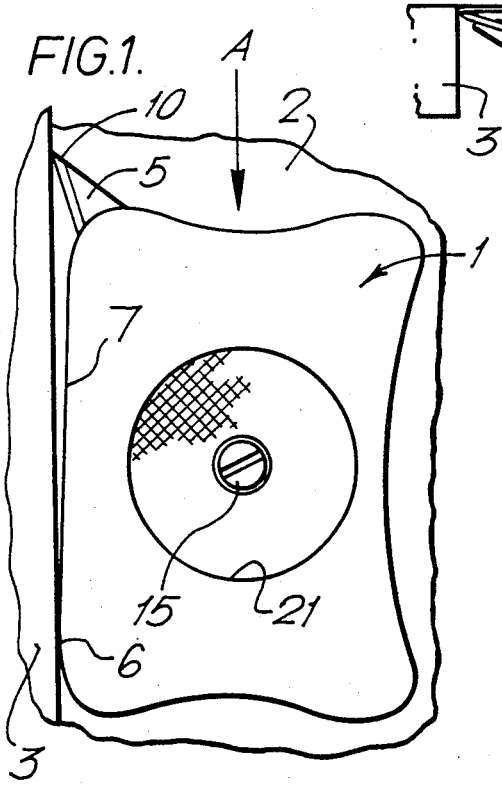
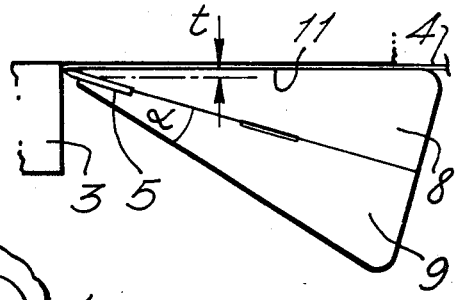
FIG. 2.
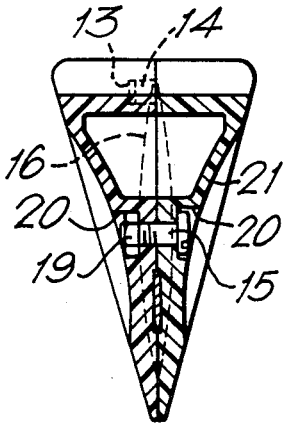
FIG. 4.
FIG.3.
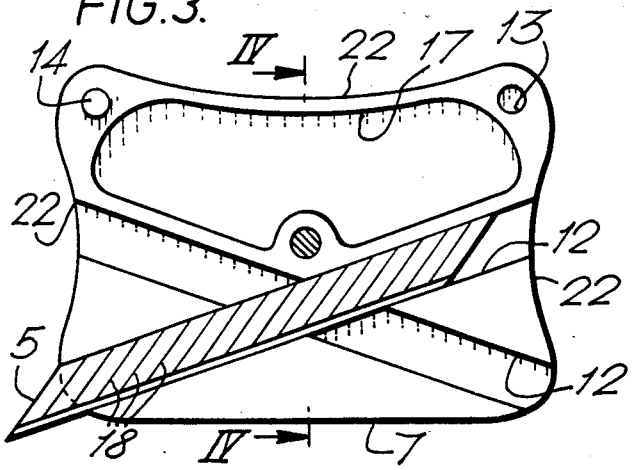

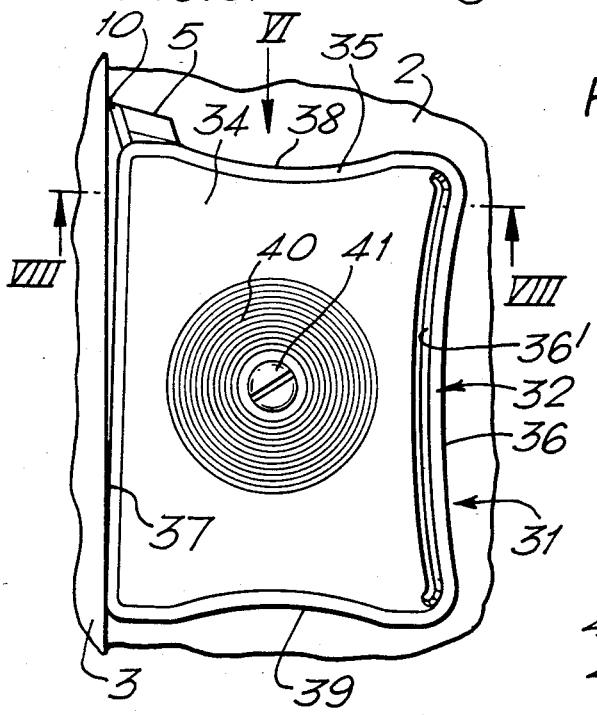
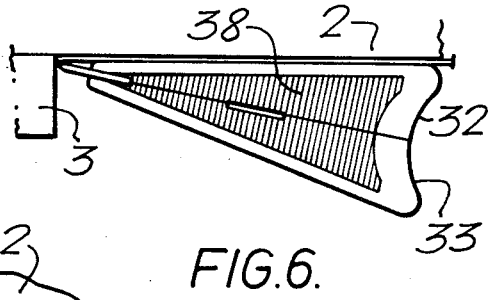
FIG.6.
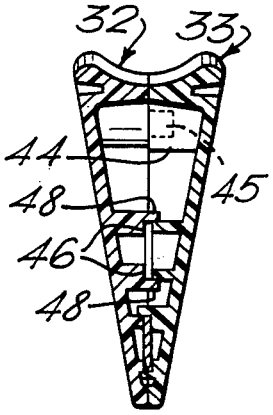
FIG.8.
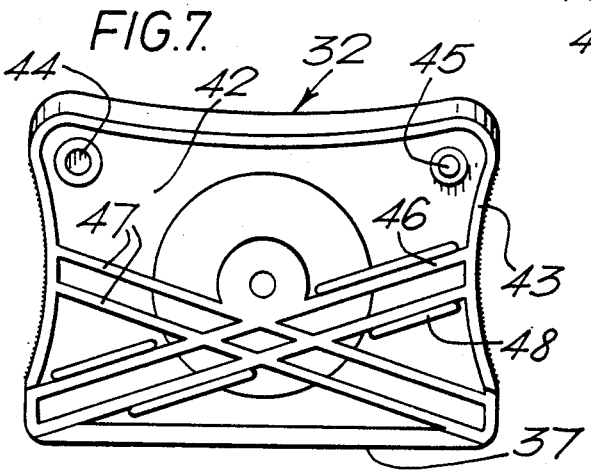

WALLPAPER KNIFE

BACKGROUND OF THE INVENTION

The present invention relates to a knife.

Various knives are in production which have retractable and/or replaceable blades. Although some of these are sold specifically for home decoration purposes, they are not particularly adapted for use in trimming wall paper.

When wall paper is to be trimmed around a door for instance at an architrave, control of the trimming knife for maintaining a constant edge can be difficult. The knife of the invention seeks to overcome this problem.

SUMMARY OF THE INVENTION

According to the invention there is provided a knife comprising:

a blade, a blade holding body, and means for securing the blade in the body;

the body having opposite faces on respective opposite sides thereof, each side face being adapted to slide stably in use on a flat surface and defining a plane which in use is substantially coincident with the flat surface, the two side faces defining therebetween a shallow angle;

the blade being securable in the body with its tip extending from the body whereby it is at a pre-determined distance from the flat surface when the body is positioned with one of the side faces in its use position on the flat surface.

The blade may be held with its tip coincident with the flat surface, in which case the predetermined distance is of zero length. Normally the blade will be held with its tip in the region of 1 mm from the surface.

In use for trimming wall paper around an architrave, the knife body is held against the wall paper which will have been worked well into the corner between the wall and the architrave. The knife is slid against the wall paper along the architrave with the blade cutting the paper at the architrave. Because the tip is held at the predetermined distance from the wall the paper is neatly trimmed with a small tidy, constant width edge of the paper turned onto the architrave.

It is important that the knife should be stably slidable on the wall paper. For this purpose, the two side faces are preferably flat. These faces need not be continuous over the entire side of the body, but are preferably provided at least at the extremities of their sides with contact surfaces defining a plane. Each side face may have recessed portion(s) and/or aperture(s). The face need not in fact be flat; in an extreme arrangement the face may be made stably slidable by having three dimples on the slidable face.

The two side faces of the body on opposite sides of the blade are preferably similar, so that the blade tip is a predetermined distance from the flat surface whichever side face of the body is in engagement with the flat surface. These two side faces may be arranged with respect to the blade to give differing predetermined distances. However, in the preferred embodiments, the two sides are arranged to give the same predetermined distance.

The shallow angle between the two side faces will normally be less than 45° and preferably less than 35°. The optimum angle is between 25° and 18°.

The blade may be adjustably held in the body. Where, as is preferred, the blade is arranged at an angle to each side face, adjustment of the blade provides adjustment of the predetermined distance. The parts of the body on either side of the blade preferably taper equally so that the plane of the blade lies in a central plane of symmetry.

The body may be of two part construction with the blade sandwiched between the parts, preferably in a groove in the body.

Preferably, the blade is generally elongate and securable in the body at an acute angle with respect to an axis in the body along which the opposite side faces are equally spaced apart. An end face of the body at which the side faces are closest together provides a solid axis. The acute angle will normally be less than 30°, preferably between 25° and 15°.

Conveniently, the tip of the blade projects from one corner of the body and the adjacent end face of the body (at which the side faces are closest together) is engageable with and slideable over a surface transverse to the flat surface. In use, this edge may be run along the architrave, for example, in front of the blade to assist in working the paper into the wall/architrave corner. The end face opposite the mentioned end face is preferably scalloped as a finger grip, conveniently with curvature in two directions. In the preferred embodiment, the body is generally rectangular and the other two end faces are scalloped.

Where the body is of a two part construction, with the blade extending at the end of this edge, the blade is conveniently accommodated in a groove at the joint between the parts. To provide for the parts to be truly symmetric and identical, a respective blade groove directed towards each end of the said edge is provided in each body part. However, one groove only may be provided by handling the parts. Conveniently the groove is provided equally in each part, although it may be provided entirely in either.

To grip the blade the blade securing means holds the parts together and is conveniently a centrally placed screw. To secure the body parts from rotating about the screw they may be arranged to have interengaging formations. To further assure secure holding of the blade, the two body parts may be conveniently formed with a slight concave bowing at their mating surfaces and be drawn together by securing means to grippingly hold the blade. Such securing means may be centrally disposed in recesses in the side faces of the body.

Although the blade may be a replaceable scalpel blade, it is conveniently of the type having a series of nicks whereby the blunted tip of the blade may be successively snapped off. The edges and corners of the body may be smoothly curved.

To help understanding of the invention, specific embodiments thereof will now be described by way of example and with reference to the accompanying drawings in which:

DESCRIPTION OF THE DRAWINGS

FIG. 1 is a side view of a first embodiment of a knife of the invention in use at an architrave;

FIG. 2 is a top view in the direction of arrow A in FIG. 1;

FIG. 3 is a sectional view of the knife of FIG. 1 at the joint between the two parts;

FIG. 4 is a cross-sectional end view on the line IV—IV in FIG. 3;

FIG. 5 is a side view, similar to FIG. 1, of a second embodiment of knife according to the invention;

FIG. 6 is a top view in the direction of arrow VI in FIG. 5;

FIG. 7 is a view, similar to FIG. 3, of one side part of the knife body; and

FIG. 8 is a sectional view, partly broken away on the line VIII—VIII of FIG. 5.

DESCRIPTION OF THE FIRST EMBODIMENT

Referring first to FIG. 1, the knife 1 can be seen in use sliding against a wall 2 at an architrave 3. The knife has a blade 5, which is gripped between two body parts 8,9. The body parts taper towards an end face 7 and have outer side faces 11. At the end face 7 both body parts have their thinnest thickness t. If the tip 10 of the blade 5 were moved back into the body of the knife from its position shown in FIG. 2 to the edge 7, the tip would be spaced from the wall 2 with which one of its side faces 11 is coincident in use by a distance equal to the thickness t. Normally the blade will extend to an extent such as shown in FIG. 2. Since the blade's central plane is coincident with the joint plane between the body parts, which plane is at the angle $\alpha$ of taper with the side faces 11, the tip of the blade is at a certain distance from the plane of the side surface, and of the wall, which is somewhat less than t and is typically 1 mm. In FIG. 2, wall paper 4 can be seen being trimmed by the blade 5 of the knife along the architrave 3 with one of the side faces 11 sliding on the wall paper 4 on the wall 2. The wall paper 4 is well worked into the corner between the wall and the architrave and kept there by the end 6 of the knife body opposite the blade 5 at an edge 7 of the knife. In this embodiment, the angle $\alpha$ is 16° with the shallow angle between the side faces 11 being 32°.

By virtue of the tip of the blade being the predetermined distance of 1 mm from the wall, the wall paper is trimmed neatly with a 1 mm. edge turned onto the architrave. The height of this edge can be controlled by altering the extent of the blade.

Turning now to FIG. 3, in order to make the two body parts identical for injection moulding purposes, when as preferred the body parts are of plastics material, at their joint face each has a pair of crossed blade grooves 12. The grooves extend at an acute angle of 19° to the end face 7. When the two halves are brought together only one of the thus formed grooves is in fact used. Each body part has a complementary recess 13 and spigot 14 for interengaging and positioning the body parts correctly with respect to each other. A centrally placed screw 15 holds the body parts together. To assist gripping of the blade 5 especially at the edge 7, the body parts are preferably slightly concave, see exaggerated dashed line 16 in FIG. 4. Secure holding of the blade is further assured by the depth of the grooves 12 being just under half the thickness of the blade. FIG. 3 shows a recess 17 for keeping down the wall thickness of the body parts, and nicks 18 in the blade for breaking off its tip when blunt.

The head of the screw 15 and its nut 19 are accommodated in recesses 20 which open into depressions 21 having a roughened surface for a thumb grip. The end faces 22 of the knife body are of scalloped shape to provide finger grips, which each have a roughened surface.

In the second embodiment, illustrated in FIGS. 5 to 8, the knife 31 comprises two side parts 32 and 33 (FIG. 6), each of which has an identical formation on its engaging inside face (FIG. 7). The external side faces (FIG. 5) are similar and differ only in that one is centrally moulded to receive non-rotatably a nut whilst the other has a recess for a rotatable screw head. The side face 34 of the part 32 has a peripheral bead 35 defining a plane whereby the side face 34 is engageable upon and slidable over a flat surface such as a wall 2 in a stable manner. Within the bead 35, the side face 34 is roughened for gripping.

The part 32 tapers from one wide end face 36 to a narrow end face 37 at an angle of 10½%, giving an included angle of 21° between the two side faces of the body. The end face 36 is curved concavely in two directions and the end face 37 is straight. At the end face 36, the sideface 34 is provided with a groove 36' to maintain as even a thickness as possible, for moulding purposes. Upper and lower end faces 38 and 39 are also curved concavely and ribbed to provide finger grip (FIG. 6). The corners of the part 32 are smoothly curved. A central part-spherical dished recess 40 is formed in the side face 34. In the centre is a recess and through hole for a machine screw 41 by which the two parts 32 and 33 may be secured as in the previously described embodiment.

The inside face of the part 32 (FIG. 7), is hollow and projecting from its base 42 is a peripheral wall 43 to engage a similar wall of the part 33. A boss 44 with a central aperture and a spigot 45 project from the base 42 at positions symmetrically about the centre line, so that similar components on the part 33 form interengaging formations to prevent relative rotation.

Two pairs of rails 46 and 47 project from the base 42 and are spaced slightly below the level of the peripheral wall 43. The pairs of rails extend from opposite corners of the part 32 adjacent the end face 37 at equal angles. Upwardly projecting webs 48 extend from the base 42 along either side of the rails 46, so that when assembled with similar components on the part 33 the rails 47 on each part are embraced between the webs 48 on the other parts, two grooves are formed in the body between the parts, into either of which a tipped cutting blade 5 similar to that in the previously described embodiment may be fitted. The total depth of groove should be just less than the thickness of the blade to improve gripping. The depth in each part is thus just less than one half the thickness.

To prepare for use, a blade 5 is placed in the groove formed in the body, either on the rails 46 or 47 in the part 32. Whichever way the blade is oriented the knife can be used to work up or down as preferred against an architrave on the left or right of a door, due to the symmetry of the body. The blade 5 is adjusted along the groove so that its tip 10 projects from the corner of the knife to a predetermined, desired distance from a flat surface upon which the flat face of the peripheral bead 35 rests with the plane defined by the bead coincident with the flat surface. The angular disposition of the blade 19° to the flat face enables this to be done accurately. The two parts 32 and 33 are then secured together by screw 41 and nut (not shown).

The knife is then placed in position as described previously with the corner of the end face 37 remote from the blade tip 10 in engagement with a surface transverse to the flat surface, such as an architrave 3. The knife can then be used as previously described.

In order to secure the blade firmly in position, the two parts 32 and 33 may be slightly concavely bowed as described previously. Alternatively, the non-cutting edge of the blade 5 may have a series of notches each corresponding to a portion of the blade defined by a nick 18 (FIG. 3). Then one or more complementary knobs on the upper of the rails 46 and 47 would enter one or more of the notches when the blade was in position to prevent movement of the blade into the knife under applied pressure in use. In this case, of course, the blade position would not be adjustable.

It will be appreciated that to ensure a stable engagement and sliding of the knife over the flat surface of the wall 2, the side face of the knife should engage the flat surface at least at three triangulated positions, one position being offset from the line joining the others. Thus the engagement positions, instead of extending around the whole periphery, could be restricted to, for example, the corners of the end face 36 and the middle of the end face 37.

As described above the inside of the parts 32 and 33 are identical. This is convenient in economising on tooling. Another alternative is that the end faces 38,39 at the corners with the end face 37 be at the angle of the nicks 18 in the blade, when in the knife, to assist breaking off of the blade.

I claim:

1. A wallpaper knife comprising:

a substantially flat blade having a tip, a blade holding body, and means for securing said blade in said body, said body having:

side faces on opposite sides thereof, each said side face being adapted to slide stably in use on a flat surface and defining a plane which is substantially coincident with the flat surface, the two side planes defining therebetween a shallow angle and a line of intersection of said planes, an end face at which said two side faces are closest together and which is spaced from said line of intersection, and an internal substantially flat blade seat in said body and opening at said end face, said tip of said blade being positioned on a tip line extending from said line of intersection to said opening of said blade seat;

said blade being securable at said seat with said tip spaced at a predetermined distance from both said planes, and the flat surface when said body is positioned with one of said side faces in its use position on the flat surface, in accordance with the position of said tip along said tip line.

2. A knife according to claim 1, wherein said shallow angle is between 25° and 18°.

3. A knife according to claim 1, wherein said blade is inclined to both of the side faces.

4. A knife according to claim 1, wherein said blade is held in a plane of symmetry between said two opposite side faces and its tip is securable at substantially the same predetermined distance from the flat surface whichever of said two side faces is in its use position on the flat surface.

5. A knife according to claim 1, wherein each said side face is substantially flat at least in the area of the peripheral portions thereof.

6. A knife according to claim 1, wherein said blade is generally elongate and securable in said body at an acute angle with respect to said end face.

7. A knife according to claim 6, wherein said acute angle is between 25° and 15°.

8. A knife according to claim 1, wherein the tip of said blade projects from a corner of said body at said end face of the body, which is engageable with and slidable over a surface transverse to the flat surface.

9. A knife according to claim 8, wherein the end face opposite from said end face is scalloped as a finger grip.

10. A knife according to claim 9, wherein said opposite end face is scalloped with curvature in two directions.

11. A knife according to claim 8, wherein said body is generally rectangular and the other two end faces are scalloped.

12. A knife according to claim 1, wherein said body is of two part construction.

13. A knife according to claim 12, wherein said blade is held in a groove in said body.

14. A knife according to claim 13, wherein said groove is in both parts of said body.

15. A knife according to claim 14, wherein there are two crossed half grooves in each said part of said body, so that said parts are similar.

16. A knife according to claim 14, wherein said grooves are of equal depth.

17. A knife according to claim 12, wherein said parts have a slight concave bowing to their engaging faces, and are drawn together by said blade securing means to grippingly hold said blade.

18. A knife according to claim 17, wherein said blade securing means is centrally disposed in recesses in said side faces of said body.

19. A knife according to claim 12, wherein said body parts have inter-engaging formations to prevent relative rotation.

20. A knife according to claim 1, wherein said blade is adjustably securable in said body to permit alteration of said predetermined distance.

21. A knife according to claim 1, wherein the blade is frangible at a series of nicks provided along its length.

22. A wallpaper knife comprising a handle having the shape of a truncated isosceles triangle in a cross-section perpendicular to the line of cutting of the knife and a replaceable elongated blade held thereby, said handle comprising two mating halves, joining proximate the center line of said isosceles triangle and ending at the truncated apex thereof in a guiding edge, said halves being adapted to hold at their parting line said elongated blade therebetween with said elongated blade projecting slightly from an end of said handle at said guiding edge and at an angle thereto, each outside face of said handle on either side of said parting line defining a planar surface adapted to guide said knife along a wall, and said blade being within an envelope formed by said two planar surfaces whereby it is spaced from each.

* * * * *